US009818267B2

(12) United States Patent
Parker et al.

(10) Patent No.: US 9,818,267 B2
(45) Date of Patent: Nov. 14, 2017

(54) DOORBELL SYSTEM AND DOORBELL CHIME

(71) Applicant: NOVAR ED&S Limited, Bracknell, Berkshire (GB)

(72) Inventors: Christopher Parker, London (GB); Dominic Hargreaves, Stratford Upon Avon (GB); Felix Haeffner, London (GB); Iphin Rangson, London (GB)

(73) Assignee: Novar ED&S Limited, Bracknell (GB)

( * ) Notice: Subject to any disclaimer, the term of this patent is extended or adjusted under 35 U.S.C. 154(b) by 0 days.

(21) Appl. No.: 14/967,769

(22) Filed: Dec. 14, 2015

(65) Prior Publication Data

US 2016/0171847 A1 Jun. 16, 2016

(30) Foreign Application Priority Data

Dec. 15, 2014 (GB) ..... 1422234.3

(51) Int. Cl.
*G08B 27/00* (2006.01)
*G08B 3/10* (2006.01)
*G08B 13/00* (2006.01)

(52) U.S. Cl.
CPC ..... *G08B 3/10* (2013.01); *G08B 13/00* (2013.01)

(58) Field of Classification Search
CPC ..... G08B 3/10; G08B 13/00
USPC ..... 340/326
See application file for complete search history.

(56) References Cited

U.S. PATENT DOCUMENTS

| | | | |
|---|---|---|---|
| D118,866 | S | 2/1940 | Rittenhouse |
| D120,424 | S | 5/1940 | McMullen |
| D122,293 | S | 9/1940 | Guild |
| D199,875 | S | 12/1964 | Stevenson |
| D207,755 | S | 5/1967 | Stevenson |
| D208,339 | S | 8/1967 | Stevenson |
| D215,187 | S | 9/1969 | Doggart |
| D215,375 | S | 9/1969 | Doggert |

(Continued)

FOREIGN PATENT DOCUMENTS

| | | |
|---|---|---|
| CN | 2105741 | 5/1992 |
| CN | 1245950 | 3/2001 |

(Continued)

OTHER PUBLICATIONS

Search Report for GB Application No. 1422234.3, dated May 28, 2015.

(Continued)

*Primary Examiner* — Naomi Small
(74) *Attorney, Agent, or Firm* — Seager, Tufte & Wickhem, LLP

(57) ABSTRACT

A doorbell system comprises a doorbell chime (18), a first doorbell push (10) for sending a first input signal to the doorbell chime (18) in response to the first doorbell push (10) being activated, and a second device, such as a second doorbell push (14), for sending a second input signal to the doorbell chime (18). The doorbell chime (18) is arranged to emit light (24) of a first color in response to receiving the first input signal and light of a second, different, color in response to receiving the second input signal. The light (24) may be emitted around a perimeter of the doorbell chime, such that it creates a halo effect around the part of the door chime located within said perimeter.

15 Claims, 3 Drawing Sheets

(56) References Cited

U.S. PATENT DOCUMENTS

| | | | |
|---|---|---|---|
| D223,304 | S | 4/1972 | Doggart |
| D258,424 | S | 3/1981 | Doggart |
| D261,117 | S | 10/1981 | Lewis |
| D261,118 | S | 10/1981 | Perhacs, Jr. |
| D264,196 | S | 5/1982 | Doggart |
| D264,320 | S | 5/1982 | Doggart |
| D280,082 | S | 8/1985 | Levin et al. |
| D280,083 | S | 8/1985 | Levin et al. |
| D284,069 | S | 6/1986 | Levin |
| D284,173 | S | 6/1986 | Levin |
| D284,174 | S | 6/1986 | Levin |
| D284,175 | S | 6/1986 | Levin |
| D300,528 | S | 4/1989 | Drane |
| D302,545 | S | 8/1989 | Drane |
| D304,453 | S | 11/1989 | Matsushima |
| 4,998,045 | A | 3/1991 | Ruby |
| D353,345 | S | 12/1994 | Dawson |
| 5,428,265 | A | 6/1995 | Booth, Jr. et al. |
| D380,167 | S | 6/1997 | Ryan |
| D381,594 | S | 7/1997 | Ryan |
| D382,220 | S | 8/1997 | Huang |
| D382,502 | S | 8/1997 | Ryan |
| D385,208 | S | 10/1997 | Chui |
| D392,576 | S | 3/1998 | Pun |
| 5,774,039 | A | 6/1998 | Housley |
| D406,110 | S | 2/1999 | Ryan |
| D410,404 | S | 6/1999 | Scheibe |
| D415,444 | S | 10/1999 | Mooney et al. |
| D422,234 | S | 4/2000 | Artuz, Jr. |
| D439,186 | S | 3/2001 | Kovens et al. |
| D440,509 | S | 4/2001 | Greene |
| D459,670 | S | 7/2002 | Bergstrom |
| D478,832 | S | 8/2003 | Dipple |
| 6,815,625 | B1 | 11/2004 | Leopold et al. |
| 7,098,610 | B2 | 8/2006 | Rodriguez |
| 7,180,021 | B2 | 2/2007 | Birdwell |
| 7,190,124 | B2 | 3/2007 | Kumar et al. |
| D541,689 | S | 5/2007 | Meyers et al. |
| 7,259,527 | B2 | 8/2007 | Foo |
| D555,026 | S | 11/2007 | Teiber et al. |
| 7,332,683 | B2 | 2/2008 | Gorman |
| 7,339,331 | B2 | 3/2008 | Vanderzon |
| D572,162 | S | 7/2008 | Beland et al. |
| D572,619 | S | 7/2008 | Beland et al. |
| D573,500 | S | 7/2008 | Beland et al. |
| D573,501 | S | 7/2008 | Beland et al. |
| D574,284 | S | 8/2008 | Beland et al. |
| D574,742 | S | 8/2008 | Spencer |
| D574,743 | S | 8/2008 | Beland et al. |
| D576,904 | S | 9/2008 | Beadle |
| D579,250 | S | 10/2008 | Cittadino et al. |
| 7,570,031 | B2 | 8/2009 | Salvestrini |
| 7,576,292 | B2 | 8/2009 | Birdwell et al. |
| 7,586,718 | B1 | 9/2009 | Radosavljevic et al. |
| D605,542 | S | 12/2009 | Ho |
| D610,031 | S | 2/2010 | Beland et al. |
| D616,321 | S | 5/2010 | Skaf et al. |
| 7,837,344 | B2 | 11/2010 | Altonen et al. |
| 7,868,561 | B2 | 1/2011 | Weightman et al. |
| D636,286 | S | 4/2011 | Khor et al. |
| D636,287 | S | 4/2011 | Khor et al. |
| D637,099 | S | 5/2011 | Khor et al. |
| 8,053,997 | B2 | 11/2011 | Salvestrini |
| 8,076,862 | B2 | 12/2011 | Thirugnanasambandham |
| 8,212,491 | B2 | 7/2012 | Kost et al. |
| 8,324,823 | B2 | 12/2012 | Choi et al. |
| 8,339,048 | B2 | 12/2012 | Newman, Jr. et al. |
| 8,344,647 | B2 | 1/2013 | Kinsella |
| 8,350,487 | B2 | 1/2013 | Thirugnanasambandham et al. |
| D710,728 | S | 8/2014 | Siminoff |
| D711,275 | S | 8/2014 | Scalisi |
| D727,769 | S | 4/2015 | Scalisi |
| D729,678 | S | 5/2015 | Scalisi |
| 2002/0149492 | A1* | 10/2002 | Buckingham ..... G08B 3/10 340/691.6 |
| 2003/0080855 | A1 | 5/2003 | Koneff et al. |
| 2004/0124978 | A1 | 7/2004 | Chen |
| 2005/0152128 | A1* | 7/2005 | Campman ..... F21S 8/035 362/95 |
| 2005/0177370 | A1* | 8/2005 | Hwang ..... G04G 13/00 704/270 |
| 2006/0038663 | A1* | 2/2006 | Steinetz ..... G08B 3/10 340/392.1 |
| 2009/0200952 | A1 | 8/2009 | King |
| 2012/0044050 | A1* | 2/2012 | Vig ..... G07C 9/00158 340/5.82 |
| 2015/0163945 | A1* | 6/2015 | Barton ..... F24F 11/006 361/809 |
| 2016/0007431 | A1* | 1/2016 | Bosua ..... H05B 37/0272 315/158 |

FOREIGN PATENT DOCUMENTS

| | | |
|---|---|---|
| CN | 101276503 | 10/2008 |
| CN | 102426730 | 4/2012 |
| CN | 203260133 | 10/2013 |
| DE | 10012082 | 10/2001 |
| EP | 1135007 | 4/2003 |
| EP | 1158841 | 2/2006 |
| GB | 2418082 | 3/2000 |
| GB | 2343796 | 5/2000 |
| JP | 2006032030 | 2/2006 |
| JP | 2008035632 | 2/2008 |
| WO | WO03/005550 | 1/2003 |
| WO | WO2007/006851 | 1/2007 |
| WO | WO2009/036517 | 3/2009 |
| WO | WO2009/099522 | 8/2009 |

OTHER PUBLICATIONS

Design U.S. Appl. No. 29/530,145, filed Jun. 12, 2015.
Design U.S. Appl. No. 29/530,148, filed Jun. 12, 2015.
Design U.S. Appl. No. 29/530,150, filed Jun. 12, 2015.
Design U.S. Appl. No. 29/530,151, filed Jun. 12, 2015.
http://12.153.20.72/cgi-bin/chimeswdc.cgi?product=1, "Heath Zenith Lighting and Door Chimes, Model 57-1/M," 1 page, printed Oct. 24, 2007.
http://bellman.com/en/our-solutions/home-altering-solutions/, "Home Alerting Solutions," 7 pages, printed Jun. 30, 2015.
http://doorchimesuk.co.uk/catalog/product_info.php?cPath=34&productsid=444, "Byron BY202tx 100m Plug-in Front Door/Back Door Wireless Chime Kit from Doorc . . . ," 1 page, printed Jun. 30, 2015.
http://web.archive.org/web/20141026150006/http://www.actiononhearingloss.org.uk/s . . . , "Flashing or Vibrating Doorbells—Action on Hearing Loss: RNID," 3 pages, printed Mar. 7, 2016.
http://www.friedland.co.uk/products/libraplus.htm, "Friedland Libra+ Wirefree Chimes," 3 pages, printed Mar. 24, 2008.
http://www.nutone.com/product-detail.asp?ProductID=11242, "Nutone Model BK140LWH—One 2-Note White Door Chime—Builder Kits," 2 pages, printed Oct. 24, 2007.
http://www.nutone.com/product-detail.asp?ProductID=11246, "Nutone Model BK105—One 2-Note White Door Chime—Builder Kits," 2 pages, printed Oct. 24, 2007.
https://www.google.com/search?q=door+chime&biw=1092&bih=926&s . . . , "Door Chime—Google Search," 18 pages, printed Jun. 15, 2015.

* cited by examiner

DOORBELL SYSTEM AND DOORBELL CHIME

This application claims priority to GB 1422234.3, filed Dec. 15, 2014.

FIELD OF THE INVENTION

The present invention concerns a doorbell system and doorbell chime. More particularly, but not exclusively, this invention concerns a doorbell push and chime arrangement.

BACKGROUND OF THE INVENTION

Doorbell systems, typically comprising a doorbell push and a doorbell chime, are commonly used to alert someone inside a building of someone outside the building seeking entry to the building. The doorbell push is typically located outside the building, near an entrance to the building, for example a door. The doorbell chime is typically located inside the building, and in response to the doorbell push being activated, emits an audible alarm to inform anyone present within the building and in hearing range of the chime, that someone is seeking entry.

Some buildings may have more than one entrance with a doorbell push. In such buildings, it may be necessary to distinguish at which entrance the doorbell push has been activated. In certain circumstances, it may also be inconvenient for a doorbell chime to emit an audible alarm, for example when a young child is sleeping and/or late at night.

The present invention seeks to mitigate the above-mentioned problems. Alternatively or additionally, the present invention seeks to provide an improved doorbell system.

SUMMARY OF THE INVENTION

The present invention provides, according to a first aspect, a doorbell system comprising:

a doorbell chime, a first doorbell push for sending a first input signal to the doorbell chime in response to the first doorbell push being activated, and a second device for sending a second input signal to the doorbell chime;

the doorbell chime being arranged to emit light of a first colour in response to receiving the first input signal and light of a second, different, colour in response to receiving the second input signal.

The present invention recognises that a chime can be used to enable a user to visually differentiate between two different input signals. The chime in embodiments of the present invention can, for example, be used to not only indicate that someone has rung the doorbell (i.e. activating the first doorbell push) but also to provide a different indication of another, preferably unrelated, matter (i.e. in response to the second input signal).

The second input signal may indicate a telephone is ringing. For example the second device may be a telephone for sending a signal that a telephone is ringing. The second input signal may indicate an intruder alert. For example the second device may be detector, such as a PIR, for indicating the presence of a person in a detection area. The detector may be arranged to send a signal that a person has been detected in a particular area. The second device may be another doorbell chime. For example the doorbell chime may be networked to another doorbell chime to relay the display on that other doorbell chime. The second device may be a battery level monitor. The second input signal may be representative of a low battery in the chime.

In preferred embodiments of the invention the second device is a second doorbell push for sending the second input signal to the doorbell chime in response to the second doorbell push being activated.

The person skilled in the art will appreciate that the terms "doorbell push" and "doorbell chime" are being used as terms of the art. It is not necessary that the doorbell push is activated by a user pushing a button, and any other suitable activation methods are encompassed. For example, the doorbell push may comprise a motion activated sensor, or door contact. It is not necessary that the doorbell chime emit a chime and any other suitable methods of alerting someone inside a building that a doorbell push has been activated may be used. For example, as in the present invention, a light may be emitted.

A doorbell system according to preferred embodiments of the present invention indicates which doorbell push has been activated, and hence someone inside a building will know which entrance to attend to. For example, the light of a first colour may indicate that the doorbell push associated with a front door of the building has been activated, and the light of the second colour may indicate that the doorbell push associated with a rear door of the building has been activated.

The light of a first colour and light of a second colour are preferably easily distinguishable. For example, the first colour may be red and the second colour may be blue. Alternative colours may include orange, yellow, green, and/or purple.

In an alternative aspect to the invention, the light of the first colour and light of the second, different colour, may be replaced by emitting light according to a first on/off pattern and emitting light according to a second on/off pattern. For example, the first doorbell push could be associated with continuous emission of light for a set period, and the second device (for example the second doorbell push) could be associated with an intermittent emission of light (flashing) for the same set period.

The doorbell system may comprise a third input device for sending a third input signal to the doorbell chime, wherein the doorbell chime is arranged to emit a light of a third colour in response to receiving the third input signal. The third device may be a third doorbell push, wherein the doorbell chime is arranged to emit a light of a third colour in response to the third doorbell push being activated. The third colour is preferably different to both the first colour and the second colour.

The doorbell chime may comprise a light unit, the light unit arranged to emit the light of a first colour and light of a second, different, colour. The light unit may comprise one or more LEDs.

The light unit may be formed around a perimeter of the doorbell chime. The light unit may be formed around a perimeter of a face of the doorbell chime. The doorbell chime may be approximately cuboid in shape and the light unit may be formed around a perimeter of one face of the cuboid. The doorbell chime may have a face which is approximately triangular, or circular in shape, and the light unit may be formed around the perimeter of such a face. The light unit is preferably arranged such that, when illuminated, it creates a halo effect (for example around part of the door chime located within the perimeter). Such a halo effect has been found to be especially effective at alerting a user located at a significant distance from the chime. Thus, the arrangement may enable a user to readily identify that someone is activating one of the doorbell pushes, as well as indicating which of the doorbell pushes that is (or indicating another status dependent on the nature of the second device).

The doorbell chime may comprise a speaker unit, the speaker unit arranged to emit one or more sounds. The speaker unit may comprise a mesh cover. The doorbell chime may comprise a light unit extending around the outside of the mesh cover of the speaker unit. Alternatively, the doorbell chime may comprise a light unit surrounded by a speaker unit.

The doorbell chime may be arranged to emit a first audible alarm in response to the first doorbell push being activated. The doorbell chime may be arranged to emit a second audible alarm in response to the second input signal being received (for example in response to the second doorbell push being activated). The first audible alarm may be the same as the second audible alarm. The first audible alarm may be different to the second audible alarm. Providing different audible alarms may also indicate which doorbell push has been activated.

The doorbell system may be arranged to operate in a first mode, where the first audible alarm and second audible alarm may be emitted, and a second, muted, mode, where the first audible alarm and second audible alarm are deactivated. The doorbell chime may comprise a user activated switch for switching between the first mode and second mode. The doorbell chime may switch from the second mode to the first mode in dependence on the output of a timer circuit. The doorbell chime may switch between the first mode and the second, muted, mode according to a timer circuit. The timer circuit may be activated by a user of the doorbell chime, such that the user can select the duration over which the chime is in the second, muted, mode. The user activated switch may be a single switch. The chime may be arranged such that the number of consecutive presses of the switch (in short succession) determines the duration for which the chime stays in the second, mute, mode. For example, a single actuation may be such that the chime is continuously in the mute mode (absent any active instruction to return it to the first mode). Two consecutive actuations may be such that the chime is in the mute mode only for a first predetermined period of time. Each additional consecutive actuation may be such that the chime is in the mute mode for an additional predetermined increment of time. The magnitude of the additional increment of time is preferably the same as the first predetermined period of time. For example, after two consecutive actuations of the switch, the chime may be in mute mode for 3 hours; after three consecutive actuations of the switch, the chime may be in mute mode for 6 hours; after four consecutive actuations of the switch, the chime may be in mute mode for 9 hours etc.

The chime may comprise a plurality of indicators arranged in an approximately circular pattern around the user activated switch. The plurality of indicators may be arranged such that they correspond with the various sections of a clock face. For example, there may be 4 indicators, each being associated with a 3 hour time period.

The light unit may be arranged to continuously emit light for an extended period of time. The light unit may be operable in a night light mode. The night light mode may be initiated by a user pressing a button or otherwise activating the night light mode. The night light mode may remain operable until deactivated by a user. In other embodiments, the nightlight may remain operable for a set period of time, for example eight hours. In such an embodiment, the chime is preferably arranged to be able to receive mains power. The light unit may be arranged to emit light in response to a timer. The timer may be set to activate the light unit by a user or engineer installing the doorbell chime, or by a factory setting. The emission of light by the light unit may be independent of the activation of the doorbell chime by a doorbell push.

The chime may comprise a second light source. The second light source preferably illuminates when a doorbell push is activated. The second light source may be a fixed colour. The second light source may be a white light source. The second light source may be arranged to cast light upon a structure (e.g. a wall) in the vicinity of the chime. Such an arrangement provides another clear indication to the user when the doorbell push is being pressed, as the light cast onto the structure tends to be readily visible from a distance. The second light source may be arranged to flash.

According to a second aspect of the invention, there is provided a method of operating a doorbell system, the doorbell system according to embodiments of the first aspect of the invention, wherein the method comprises the steps of:

in response to the first doorbell push being activated, emitting light of a first colour from the light unit; and in response to the second doorbell push being activated, emitting light of a second, different colour from the light unit.

According to a third aspect of the invention, there is provided a doorbell chime comprising a speaker unit, the speaker unit movable between an exposed position and unexposed position, and a light unit, the light unit movable between an exposed position and unexposed position, the speaker unit and light unit arranged such that when the speaker unit is in the exposed position, the light unit is in the unexposed position, and when the light unit is in the exposed position, the speaker unit is in the unexposed position.

The speaker unit may be movable into a partially exposed position. The light unit may be movable into a partially exposed position. The speaker unit and light unit may be arranged such that when the light unit is in a partially exposed position, the speaker unit is in a partially exposed position.

The speaker unit and the light unit may be formed as part of a unitary body. The speaker unit and light unit may define opposite ends of a unitary body. The unitary body may be movably mounted in a receiving body, such that the speaker unit and light unit, when in the unexposed position, are received within the receiving body. The unitary body is preferably pivotably mounted in a receiving body, such that when the speaker unit is in the unexposed position, the light unit is in the exposed position and vice versa. The unitary body may be arranged to move in a rocker-switch motion between the above-mentioned positions.

The doorbell chime may be arranged to be activated in response to a signal from a doorbell push. The activation of the doorbell chime may comprise an audible alarm being emitted by the speaker unit. Such an arrangement may be dependent on the speaker unit being in the exposed or partially exposed position. When the speaker unit is in the unexposed position, the doorbell chime may be arranged to operate in a mute, light only, mode. The activation of the doorbell chime may comprise light being emitted by the light unit. Such an arrangement may be dependent on the light unit being in the exposed or partially exposed position. When the light unit is in the unexposed position, the doorbell chime may be arranged to operate in a sound only mode. When the speaker unit and light unit are both in a partially exposed position, the doorbell chime may be arranged to operate in a sound and light mode.

The light unit may be arranged to emit a light of a first colour in response to activation by a first doorbell push and emit light of a second, different colour, in response to activation by a second doorbell push. The speaker unit may be arranged to emit a first sound in response to activation by a first doorbell push and emit a second, different sound, in response to activation by a second doorbell push.

The doorbell chime may comprise a second light unit, the second light unit extending around at least some of the perimeter of the doorbell chime.

According to a fourth aspect, the invention provides a doorbell chime comprising a speaker, the doorbell chime arranged to operate in a first, active mode wherein the speaker is arranged to emit a sound in response to activation by a doorbell push, and a second, mute mode wherein the speaker is arranged not to emit a sound in response to activation by a doorbell push, wherein the mute mode may be initiated by a user activating a mute button, wherein the time for which the doorbell chime remains in the mute mode depends on the number of consecutive activations of the mute button by the user. The consecutive actuations are preferably in quick succession.

The chime may comprise a plurality of indicators arranged in an approximately circular pattern around the mute button. The plurality of indicators may be arranged such that they correspond with the various sections of a clock face. For example, there may be 4 indicators, each being associated with a 3 hour time period.

It will of course be appreciated that features described in relation to one aspect of the present invention may be incorporated into other aspects of the present invention. For example, the method of the invention may incorporate any of the features described with reference to the apparatus of and aspect of the invention and vice versa.

DESCRIPTION OF THE DRAWINGS

Embodiments of the present invention will now be described by way of example only with reference to the accompanying schematic drawings of which.

DETAILED DESCRIPTION

Figure 1:
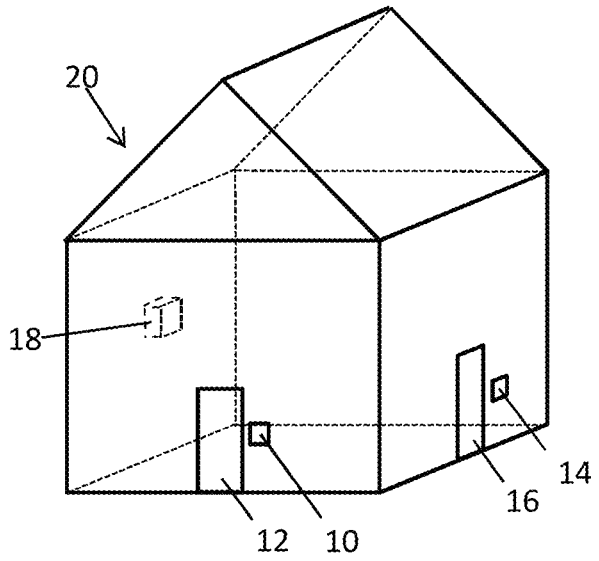
FIG. 1 shows a schematic view of a doorbell system arrangement according to a first embodiment of the invention.

FIG. 1 shows a doorbell system arrangement according to a first embodiment of the invention. A first doorbell push 10 is located close to and associated with a first entrance 12 to a building 20. A second doorbell push 14 is located close to and associated with a second entrance 16 to the building 20. A doorbell chime 18 is located within the building 20 and is arranged to emit a signal should either the first doorbell push 10 or second doorbell push 14 be activated. The first doorbell push 10, second doorbell push 14, and doorbell chime 18 may communicate wirelessly, or be in wired communication. Similarly, the first doorbell push 10, second doorbell push 14, and doorbell chime 18 may be mains powered, or battery powered.

Figure 2A:
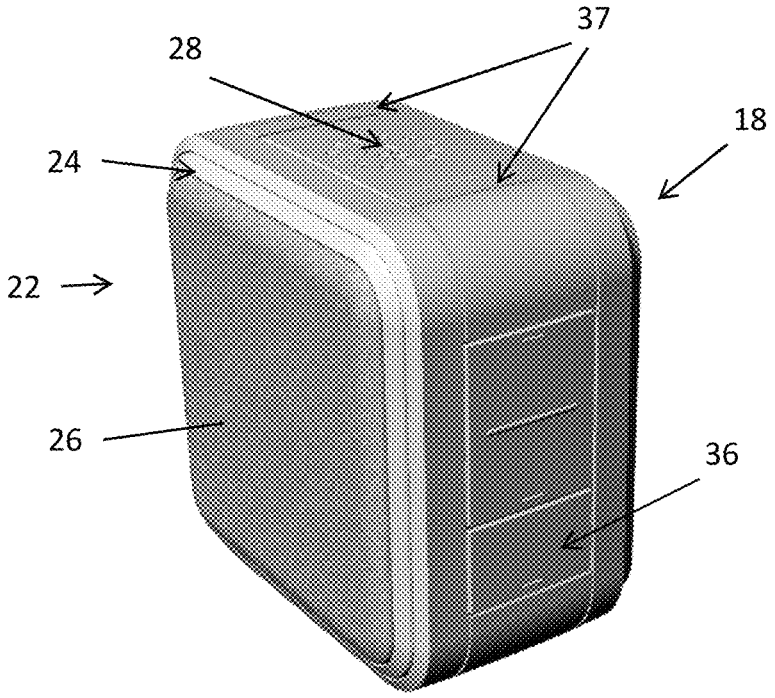
FIG. 2*a* shows a perspective view of a doorbell chime according to the first embodiment of the invention.
Figure 2B:
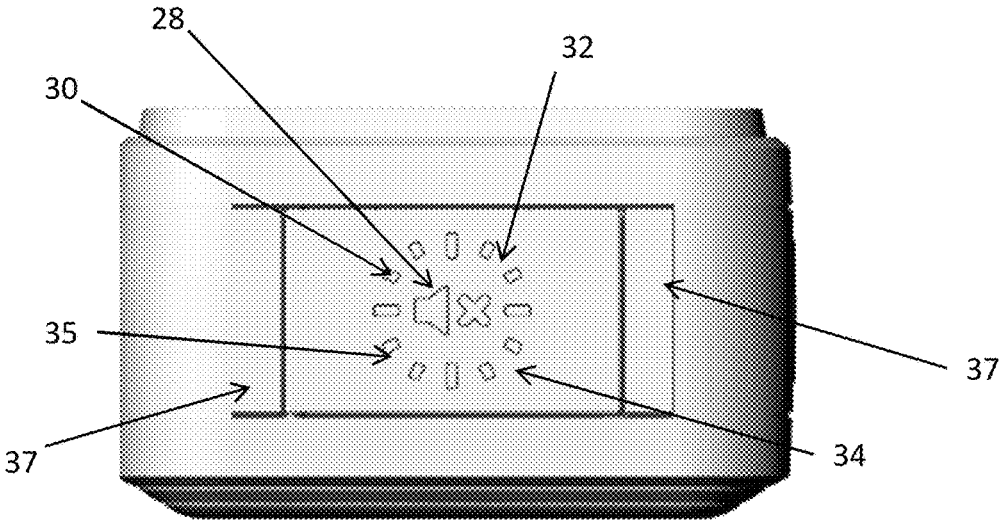
FIG. 2*b* shows a plan view of the doorbell chime in FIG. 2*a;*

FIGS. 2*a* and 2*b* show schematic views of the doorbell chime 18. The doorbell chime 18 is approximately cuboid in shape, presenting an approximately square end face 22. A light unit 24 extends around the perimeter of the end face 22, with a speaker unit 26 located within the boundary defined by the light unit 24. The light unit 24 may comprise one or more LEDs, or any other suitable light source as will be understood by a skilled person. The light unit 24 is arranged to emit at least two different colours. In this case, the light unit is arranged to emit a blue colour when the first doorbell push is activated, and a red colour when the second doorbell push is activated. Therefore, when the doorbell chime emits a blue colour, it is clear that a visitor is at the first entrance 12, and when the doorbell chime emits a red colour, it is clear that a visitor is at the second entrance 16.

By virtue of the light unit 24 surrounding the mesh of the speaker unit 26, the light source, when illuminated, provides a halo effect. This is easily visible from some distance away. Thus, it is possible to tell that someone is ringing the doorbell push, even when located a significant distance from the chime. By virtue of the different colours being emittable by the light unit 24, it is also possible to tell (from that distance) which doorbell push is being pressed.

It will be appreciated that doorbell chime is arranged to emit the light for a time limited period after a doorbell push has been activated, and not necessarily only when the push is actually being pressed. In addition to the doorbell chime 18 emitting light when activated by a doorbell push, the doorbell chime 18 may emit a sound through the speaker unit 26 to further notify those within the building 20 that someone is outside the building 20 and requesting entry.

The doorbell chime 18 includes a mute button 28 (showing the symbol of a speaker and a cross). The mute button 28, when pushed, deactivates the speaker unit 26 such that operation of either the first doorbell push 10 or second doorbell push 14, only results in the light unit 24 being activated, and a light being emitted, with no sound emitted by the speaker unit 26. The deactivation of the speaker lasts for a time determined by the number of actuations of the mute button 28. If it is actuated once only, the speaker is deactivated (until the user actively returns the chime to the first mode—for example by a subsequent, much later, press of the mute button 28). If the mute button 28 is pressed twice (in quick succession), the speaker is deactivated for three hours. If the mute button 28 is pressed three times (in quick succession), the speaker is deactivated for six hours. If it is pressed four time (in quick succession), the speaker is deactivated for nine hours, etc.

The doorbell chime 18 comprises a plurality of indicators 30, 32, 34, 35 surrounding the mute button 28. The indicators are arranged as quarters of a clock face, each indicator comprises two illuminated dashes corresponding to the time increments between the 12, 3, 6 and 9 o'clock locations (although in other embodiments each indicator could comprise a different number of dashes). The number of the indicators that illuminate, corresponds to the period for which the chime is muted (e.g. all of them for a 12 hour mute, or half of them for a 6 hour mute).

FIGS. 2*a* and 2*b* show the doorbell chime 18 as a standalone unit, which includes an internal battery to power the chime. However, in an alternative arrangement, the doorbell chime 18 may be connected to and powered by a mains supply. The doorbell chime 18 may also be arranged such that the light unit 24 can act as a night light. The light unit 24 may be arranged to emit light of a third colour, different to the first colour and second colour, when being used as a night light. The night light feature may be overridden by a user operating the first doorbell push 10 or second doorbell push 14, such that the first colour light or second colour light is emitted as appropriate. The night light feature may be reactivated after a set period of time. The night light feature may be activated by a user operated switch 36.

The chime in FIGS. 2*a* and 2*b* also has a second light source adjacent the mute button 28 and indicators 30, 32, 34, 35. The second light source 37 comprises two parallel LED strips which illuminates when either doorbell push is activated (but in this embodiment, the second light source is a fixed colour). It is angled upwards such that it illuminates a structure (e.g. a wall) near the doorbell chime 18. This provides another clear indication to the user when the doorbell push is being pressed, as the light cast onto the structure tends to be readily visible from a distance. The second light source is a flashing light (for example to give a strobe effect), which has been found to be especially eye-catching.

Figure 3:
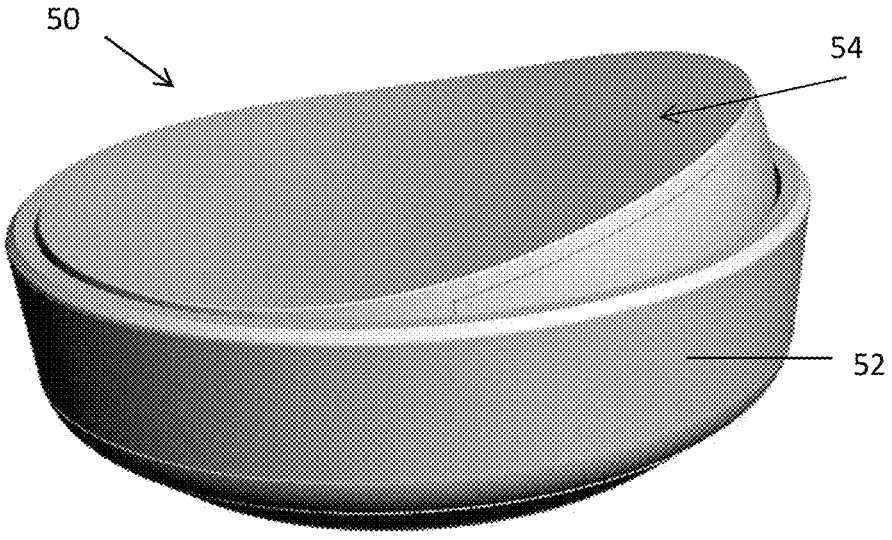
FIG. 3 shows a perspective view of a doorbell chime according to a second embodiment of the invention.
Figure 4A:
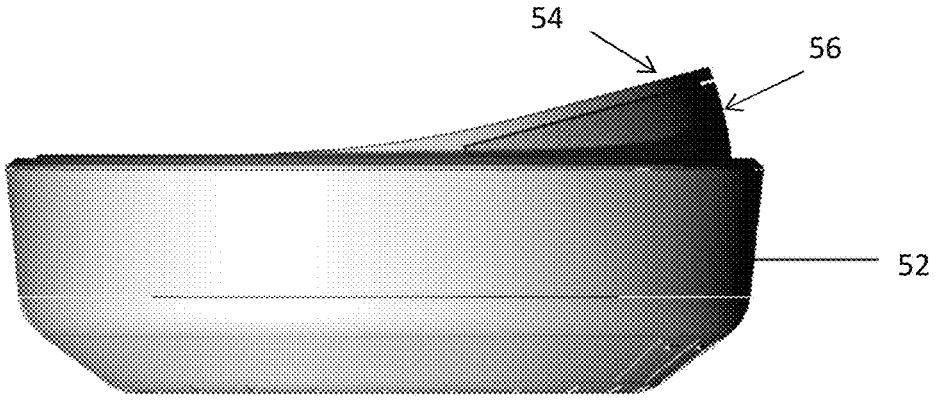
FIGS. 4*a-c* shows side views of the doorbell chime according to the second embodiment of the invention in an exposed, unexposed and partially exposed position respectively.
Figure 4B:
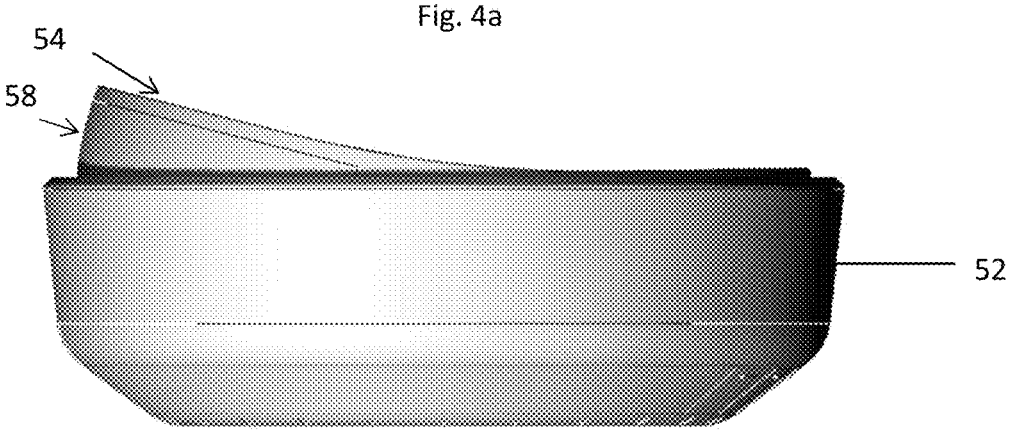
Figure 4C:
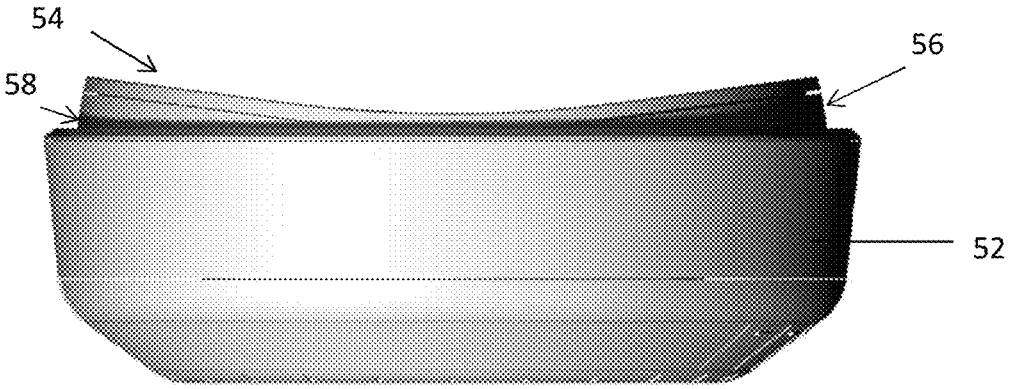

FIG. 3 shows a schematic view of a doorbell chime 50 according to a second embodiment of the invention. The doorbell chime 50 comprises a main body 52 associated with a pivotable lid 54. The lid 54 is pivoted about a central axis, such that it moves in a similar way to a rocker switch. Referring to FIGS. 4*a*-4*c*, the lid 54 comprises a speaker unit 56 and a light unit 58, located at opposite ends of the lid 54. The lid 54 is movable between at least three distinct positions. In the first position, as shown in FIG. 4*a*, the speaker unit 56 is exposed, and the light unit 58 is unexposed, such that it is fully enclosed within the main body 52 and cannot be seen when looking at the outside of the doorbell chime 50. In the second position, as shown in FIG. 4*b*, the speaker unit is unexposed, such that it is fully enclosed within the main body 52 and cannot be seen when looking at the outside of the doorbell chime 50, and the light unit 58 exposed. In the third position (shown in FIG. 4*c*), halfway between the first position and second position, both the speaker unit 56 and the light unit 58 are partially exposed. The movement of the lid 54 between the first, second, and third positions is easily undertaken by a user pushing on the lid as appropriate to select the required position.

When in the first position, when activated by a doorbell push, the doorbell chime 50 is arranged to emit an audible alarm via the speaker unit 56. No visual alarm is emitted in this position. When in the second position, when activated by a doorbell push, the doorbell chime 50 is arranged to emit a visual alarm via the light unit 58. No audible alarm is emitted in this position. When in the third position, when activated by a doorbell push, the doorbell chime 50 is arranged to emit an audible alarm via the speaker unit 56 and a visual alarm via the light unit 58. Therefore, a user can easily and intuitively switch between the various modes of operation of the doorbell chime 50.

The doorbell chime 50 also includes a light unit extending around the perimeter of the main body 52. This light unit may emit light to identify which doorbell push has been activated, or provide a night light function, both as described with reference to the first embodiment of the invention.

Whilst the present invention has been described and illustrated with reference to particular embodiments, it will be appreciated by those of ordinary skill in the art that the invention lends itself to many different variations not specifically illustrated herein. By way of example only, certain possible variations will now be described.

In another embodiment of the invention (not shown) the chime receives up to six different inputs: three different doorbell push inputs, a telephone signal (such that the light source displays a particular colour when the phone is ringing), a detector signal (such that the light source displays a particular colour when the detectors detects movement of a person outside the house), and a low battery signal (such that only the lower part of the light source is illuminated when the battery in the chime is running low).

In alternative embodiments, the doorbell chimes according to the first embodiment and second embodiment may also include volume controls and sound selection controls in order to allow a user to further personalise the doorbell chime. Such features are not shown, but will be easily understood by the person skilled in the art.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may not be desirable, and may therefore be absent, in other embodiments.

What is claimed is:

1. A doorbell system comprising:

a doorbell chime, a first doorbell push for sending a first input signal to the doorbell chime in response to the first doorbell push being activated;

a second doorbell push for sending a second input signal to the doorbell chime in response to the second doorbell push being activated;

wherein the doorbell chime further comprises:

a speaker unit comprising a mesh cover, the speaker unit arranged to emit one or more sounds; and a light unit, the light unit being arranged to emit light of a first colour in response to receiving the first input signal and light of a second, different, colour in response to receiving the second input signal, wherein the light unit is formed around a perimeter of the doorbell chime such that the light unit, when illuminated, creates a halo effect around the part of the door chime located within said perimeter.

2. A doorbell system as claimed in claim 1, comprising a third input device for sending a third input signal to the doorbell chime, wherein the doorbell chime is arranged to emit a light of a third colour in response to receiving the third input signal.

3. A doorbell system as claimed in claim 2, wherein the third colour is different to both the first colour and the second colour.

4. A doorbell system as claimed in claim 1, wherein the doorbell chime is arranged to emit a first audible alarm via the speaker unit in response to the first doorbell push being activated, and the doorbell chime is arranged to emit a second audible alarm via the speaker unit in response to the second input signal being received.

5. A doorbell system as claimed in claim 4, wherein the first audible alarm is different from the second audible alarm.

6. A doorbell system as claimed in claim 4, wherein the doorbell system is arranged to operate in a first mode, where the first audible alarm and second audible alarm may be emitted, and a second, muted, mode, where the first audible alarm and second audible alarm are deactivated.

7. A doorbell system as claimed in claim 6, wherein the doorbell chime comprises a user activated switch for switching between the first mode and second mode.

8. A doorbell system as claimed in claim 7, wherein the doorbell chime is arranged to switch from the second, muted, mode to the first mode, in dependence on an output of a timer circuit.

9. A doorbell system as claimed in claim 8, wherein the timer circuit is arranged to be activated by a user of the doorbell chime, such that the user can select a duration over which the doorbell chime is in the second, muted, mode.

10. A doorbell system as claimed in claim 7, wherein the user activated switch comprises a single switch.

11. A doorbell system as claimed in claim 10, wherein the doorbell chime is arranged such that a number of consecutive presses of the single switch determines a duration for which the doorbell chime stays in the second, muted, mode.

12. A doorbell system as claimed in claim 1, wherein the light unit is operable in a night light mode.

13. A doorbell system according to claim 1, wherein the light unit extends around the outside of the mesh cover of the speaker unit.

14. A method of operating a doorbell system, comprising:

in response to a first doorbell push being activated, emitting light of a first colour from a light unit;

in response to a second doorbell push being activated, emitting light of a second, different colour from the light unit; and wherein the light unit is formed around a perimeter of the doorbell chime, such that the light unit, when illuminated, creates a halo effect around the part of the door chime located within said perimeter.

15. A doorbell chime comprising a speaker, the doorbell chime arranged to operate in a first active mode in which the speaker is arranged to emit a sound in response to activation by a doorbell push, and a second mute mode in which the speaker is arranged not to emit a sound in response to activation by a doorbell push, wherein the second mute mode is initiated by a user activating a mute button, wherein a duration of time in which the doorbell chime remains in the second mute mode depends on a number of consecutive actuations of the mute button by the user.

* * * * *